US006354880B2

(12) United States Patent
Arai

(10) Patent No.: US 6,354,880 B2
(45) Date of Patent: Mar. 12, 2002

(54) RESISTANCE ELEMENT CONNECTING STRUCTURE OF CRT SOCKET

(75) Inventor: Atsushi Arai, Toyama-ken (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/790,094

(22) Filed: Feb. 21, 2001

(30) Foreign Application Priority Data

Feb. 21, 2000 (JP) ..... 12-043239

(51) Int. Cl.[7] ..... H01R 13/66
(52) U.S. Cl. ..... 439/620
(58) Field of Search ..... 439/620, 621, 439/683, 182

(56) References Cited

U.S. PATENT DOCUMENTS 3,916,238 A * 10/1975 Suzuki ..... 439/182
5,087,212 A * 2/1992 Hanami ..... 439/620
5,094,628 A * 3/1992 Kano ..... 439/620

* cited by examiner

*Primary Examiner*—Brian Sircus
*Assistant Examiner*—Phuong K T Dinh
(74) *Attorney, Agent, or Firm*—Morrison Law Firm

(57) ABSTRACT

A CRT socket includes a focus side discharge electrode plate formed by a projection from a metallic plate. An elastic contact piece projects from a bottom edge of the metallic plate in a direction reverse to a projecting direction of an electrode portion. An attaching frame portion for nipping and fixing both sides of the focus side discharge electrode plate is formed in a side wall surrounding a discharge air gap chamber. When the focus side discharge electrode plate is attached to the attaching frame portion, the elastic contact piece makes elastic contact with an inside lead portion of the resistance element. Accordingly, the resistance element and the focus contact are connected to each other without requiring a separate connecting device for connecting the resistance element.

5 Claims, 9 Drawing Sheets

PRIOR ART

PRIOR ART

RESISTANCE ELEMENT CONNECTING STRUCTURE OF CRT SOCKET

BACKGROUND OF THE INVENTION

1. Field of the Invention

This invention relates to the structure of a CRT (Cathode-Ray-Tube) socket for connecting a cathode ray tube used in a color television, etc., and particularly relates to a resistance element connecting structure ofthe CRT socket in which a resistance element is connected in series with a focus contact.

2. Description of the Background Art

In a CRT socket for connection to a cathode ray tube, an undesired radiating signal is generated by a high frequency signal applied to a cathode ofthe cathode ray tube through a focus circuit block. The high frequency signal influences the focus of an electronic beam. A terminal connected to a flyback transformer is attached to the CRT socket. Conventionally, a resistance element is connected in series between this terminal and a focus contact in the interior of the CRT socket to reduce the above influence.

The resistance element can be connected by directly soldering lead portions on both sides of the resistance element to the terminal and the focus contact. However, it is very difficult to make a soldering connecting work within a housing of the CRT socket, wherein the CRT socket is made as compact as possible.

Referring now to FIGS. 11–13, conventionally, a resistance element connecting structure 100 of the CRT socket connects both side lead portions of the resistance element in press contact with press contact slits concavely arranged in the terminal and the focus contact. A CRT socket 101 is assembled by attaching parts, to be described later, to a housing main body 102 from the rear. The housing main body 102 is formed by integrally molding a cylindrical housing 102*a* on one side (a lower side in FIG. 11) and a generally box-shaped housing 102*b* on the other side. A bottom face side of the box-shaped housing 102*b* has an open face to enable attachment of the constructional parts. After all ofthe parts are installed, the open face of the box-shaped housing 102*b* is covered with a bottom cover 102*c*.

The cathode ray tube is connected to a planar side of the cylindrical housing 102*a*. The cathode ray tube is attached from a bottom face side of the cylindrical housing 102*a* in contact with pins of a neck portion of the cathode ray tube such that plural contacts 104 are located on the same circular circumference on this plane side.

A contact 104F in FIG. 11 among these contacts 104 is a focus contact to which a high voltage is particularly applied in comparison with the other contacts 104. A connecting portion 105 at one end of this focus contact is pulled out into the lower measure type housing 102*b* to reliably insulate the focus contact from the other contacts 104.

As shown in FIG. 13, an end portion of the connecting portion 105 is bent in a downward U-shape. Two parallel press contact slits 106 are concavely formed in the bent portion. A connecting piece 107*a* of a focus side discharge electrode plate 107 is press-fitted into one press contact slit 106. The press contact slit 106 is electrically connected to the focus side discharge electrode plate 107. The focus side discharge electrode plate 107 has a center of the focus side discharge electrode plate 107 projecting in a spherical or conical shape.

The focus side discharge electrode plate 107 is attached to a side wall surrounding a discharge air gap chamber 108 formed within the box-shaped housing 102*b* (see FIG. 12). The focus side discharge electrode plate 107 is positioned opposite to a ground side discharge electrode plate 109 similarly formed such that the focus side discharge electrode plate 107 and the ground side discharge electrode plate 109 form a discharge gap within the discharge air gap chamber 108. This discharge gap remains quiescent while a normal voltage is applied to the focus contact 104F. When a discharge occurs within the cathode ray tube, the discharge gap discharges spark energy of this discharge to the ground side discharge electrode plate 109 to prevent discharged electric current from flowing in the reverse direction from the focus contact 104F to a semiconductor element within a circuit.

In FIG. 12, a terminal storing concave portion 111 is concavely arranged from an open face 103 on a side partitioned by a partition wall 110 from the discharge air gap chamber 108 within the box-shaped housing 102*b*. A terminal 112 is stored to the terminal storing concave portion 111. In the terminal 112, an external connecting portion 112*a* and a resistance connecting portion 112*b* are continuously integrated with each other. A portion of the terminal storing concave portion 111 for storing the external connecting portion 112*a* extends through a plane side of the box-shaped housing 102*b*. One end of an external lead wire 114, having its other end connected to a flyback transformer, is inserted from the plane side into this through hole where it comes into elastic contact with an elastic contact piece 112*c* of the external connecting portion 112*a*.

Similar to the end portion of the connecting portion 105, as shown in FIG. 13, the resistance connecting portion 112*b* is bent in a downward U-shape. A press contact slit 116 is concavely formed in this bent portion. Both side lead portions 115*a* of the resistance element 115 are respectively press-fitted into press contact slits 116, 106 of end portions of this resistance connecting portion 112*b* and the connecting portion 105 from the open face 103 of the box-shaped housing 102*b*. Thus, the resistance element 115 is connected in series between the focus contact 104F and the flyback transformer.

In this connecting work, it is sufficient to press-fit both end lead portions 115*a* of the resistance element 115 to the press contact slits 116, 106 respectively formed in the terminal 112. The connecting portion 105 of the focus contact after the terminal 112 and the focus contact 104F are attached into the box-shaped housing 102*b*. Accordingly, soldering is not required. Therefore, the connection is easily made.

However, it is desirable to make the CRT socket in a shape that is as compact as possible in order to accomplish high density mounting. But the conventional resistance element connecting structure 100 positions the resistance element 115 parallel to the open face 103 of the box-shaped housing 102*b*. Therefore, the space required for the resistance element 115 is enlarged in a plane direction of the box-shaped housing 102*b* and thereby interferes with the desire to make the CRT socket 101 compact.

Therefore, as shown in FIG. 14, a resistance element connecting structure 120 for storing the resistance element 115 in a vertical direction with respect to a box-shaped housing 121 has also been developed. In this resistance element connecting structure 120, both end lead portions 115*a* of the resistance element 115 are press-fitted into press contact slits 124, 124 formed in a terminal 122. A connecting portion 123 is connected to an unillustrated focus contact. The resistance element 115 is stored toward a side of a terminal storing concave portion 125 along an attaching direction of the terminal 122.

However, in this resistance element connecting structure 120, the resistance element 115 is attached after the terminal 122 and the focus contact are attached from an open plane side (an upper side in FIG. 14) of the box-shaped housing 121. Therefore, the lead portions 115*a* of the resistance element 115 are press-fitted to the press contact slits 124, 124 of the terminal 122 and the connecting portion 123 from the open plane side (the upper side) using a jig. Accordingly, there is no storing space for the resistance element 115 on an inner side (lower side) onto which the terminal 122 or the focus contact is attached. Therefore, the only available storing space is located in a space between the terminal 122 and the focus contact. As a result, the CRT socket is inevitably larger to permit installation of the resistance element 115.

Further, the positioning of the resistance element 115 in the vertical direction requires that press contact slits 124, 124 on sides of the terminal 122 and the focus contact are close together. Therefore, it is difficult to press-fit the bent lead portions 115*a*. Further, one lead portion 115*a* of the resistance element 115 on a side connected to the connecting portion 123 must be pulled out on the inner side (lower side). Therefore, it is necessary to arrange a lead portion having an excessive length.

OBJECTS AND SUMMARY OF THE INVENTION

To solve the above problems, an object of this invention is to provide a resistance element connecting structure of a CRT socket in which a resistance element can be connected simply work, and which does not require an increase in the size of the CRT socket for connection of a resistor.

To solve the above problems, a resistance element connecting structure of a CRT socket according to the invention comprises a focus contact connected to a focus pin of a cathode ray tube; a terminal connected to an external lead wire; a focus side discharge electrode plate connected to the focus contact; a ground side discharge electrode plate; and a box-shaped housing in which a contact storing concave portion for storing the focus contact, a terminal storing concave portion for storing the terminal, and a discharge air gap chamber for oppositely arranging the focus side discharge electrode plate and the ground side discharge electrode plate spaced from each other by a discharge gap are concavely arranged from an open face on one side of the box-shaped housing; wherein a resistance element is connected in series between the focus contact attached from the open face to the contact storing concave portion and the terminal attached from the open face to the terminal storing concave portion; the focus side discharge electrode plate is formed by a metallic plate in which a spherical electrode portion is projected at a center of the metallic plate, and an elastic contact piece is projected from a bottom edge of the metallic plate in a direction reverse to a projecting direction of the electrode portion; an attaching frame portion for nipping and fixing both sides of the focus side discharge electrode plate is formed in a side wall surrounding the discharge air gap chamber of the box-shaped housing; an inside lead portion of the resistance element having an outside lead portion connected to the terminal is arranged outside the side wall; the bottom edge of the metallic plate is directed toward the interior of the box-shaped housing, and the focus side discharge electrode plate is attached to the attaching frame portion from the open face along the side wall, and the electrode portion of the focus side discharge electrode plate faces the discharge air gap chamber, and the elastic contact piece projected to an outer side from the side wall of the discharge air gap chamber comes in elastic contact with the inside lead portion of the resistance element; and the focus side discharge electrode plate connected to the focus contact is connected to the inside lead portion of the resistance element.

The elastic contact piece is projected to the bottom edge of the focus side discharge electrode plate, and this focus side discharge electrode plate is attached to the attaching frame portion. Thus, the electrode portion of the focus side discharge electrode plate faces the discharge air gap chamber, and the elastic contact piece comes in elastic contact with the inside lead portion ofthe resistance element. Accordingly, the inside lead portion of the resistance element can be electrically connected to the focus contact only by attaching the focus side discharge electrode plate connected to the focus contact.

The resistance element can be also stored into the box-shaped housing together with the attachment of the terminal. Accordingly, the outside lead portion of the resistance element can be connected to the terminal in advance before the terminal is attached to the box-shaped housing. Therefore, the outside lead portion can be easily connected and can be also connected by soldering.

A resistance element connecting structure ofthe CRT socket according to a further aspect of the invention includes a terminal that has an external connecting portion connected to the external lead wire, and a resistance connecting portion integrally and continuously arranged on a side of the external connecting portion; a resistance storing portion is continuously arranged inward along an attaching direction of the terminal from a portion of the terminal storing concave portion storing the resistance connecting portion therein; and the resistance element having the outside lead portion connected to the terminal is stored to the resistance storing portion.

It is not necessary to connect the resistance element after the terminal is attached to the box-shaped housing. Therefore, the resistance storing portion can be continuously arranged inside the terminal storing concave portion along an attaching direction of the terminal, and the resistance element can be stored to the resistance storing portion. Accordingly, the compactness of the CRT socket remains unrestricted by need to provide a storing space for the resistance element.

A resistance element connecting structure of the CRT socket in claim 3 is characterized in that the focus contact and the focus side discharge electrode plate are integrally molded by punching the metallic plate.

Since the focus contact and the focus side discharge electrode plate are integrally molded, the number of parts is not increased. Further, the inside lead portion of the resistance element can be electrically connected to the focus contact by one attaching work for attaching the focus contact and the focus side discharge electrode plate.

DETAILED DESCRIPTION OF THE PREFERRED EMBODIMENTS

Figure 3:
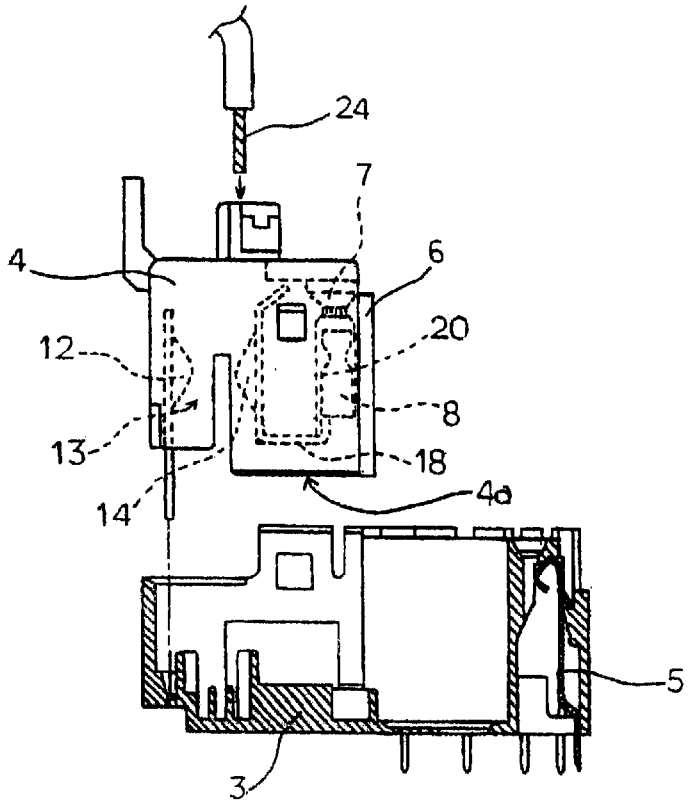
FIG. 3 is a partially broken exploded side view of the CRT socket 2.

A resistance element connecting structure 1 of a CRT socket 2 in an embodiment of the present invention will next be explained by FIGS. 1 to 10. A housing of the CRT socket 2 includes a base housing 3 and a box-shaped housing 4. A front portion (an upper portion in FIG. 1) of the base housing 3 is cylindrical. A rear portion of the base housing 3 is box-shaped, open on its upper face. An open face is formed on a bottom face side of the box-shaped housing 4. A contour of the box-shaped housing 4 is approximately the same as a contour along a rear inner wall of the base housing 3. As shown in FIG. 3, the box-shaped housing 4 is installed from above and to the rear of the base housing 3. Thus, engaging portions of both the base housing 3 and the box-shaped housing 4 are engaged and integrated with each other. When the engaging portions are integrated, an open face 4*a* of the box-shaped housing 4 on its bottom face side is covered by the rear of the base housing 3.

A plurality of contacts 5 are attached to the cylindrical front portion of the base housing 3 from a bottom face side of the front portion. The contacts 5 are located on a circular circumference concentric to a cylinder on a plane side of the base housing 3. The plurality of contacts 5 are inserted into fitting contact with respective pins of a neck portion 9 of a cathode ray tube inserted from the plane side. This provides electrical connection to these pins.

Figure 1:
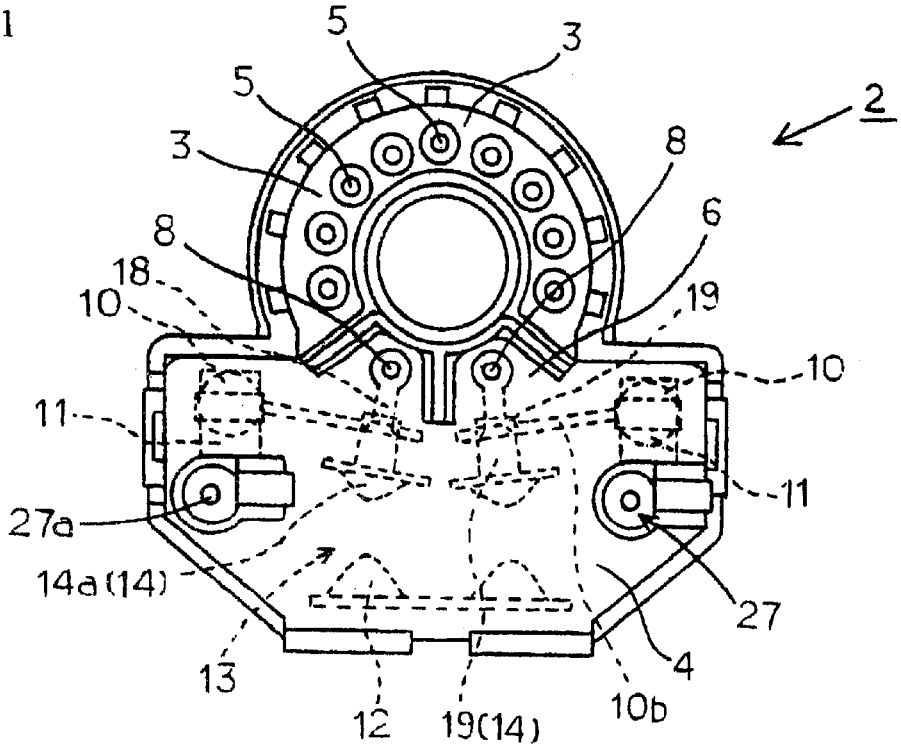
FIG. 1 is a plan view of a CRT socket 2 having a resistance element connecting structure 1 of the CRT socket according to an embodiment of the present invention.
Figure 2:
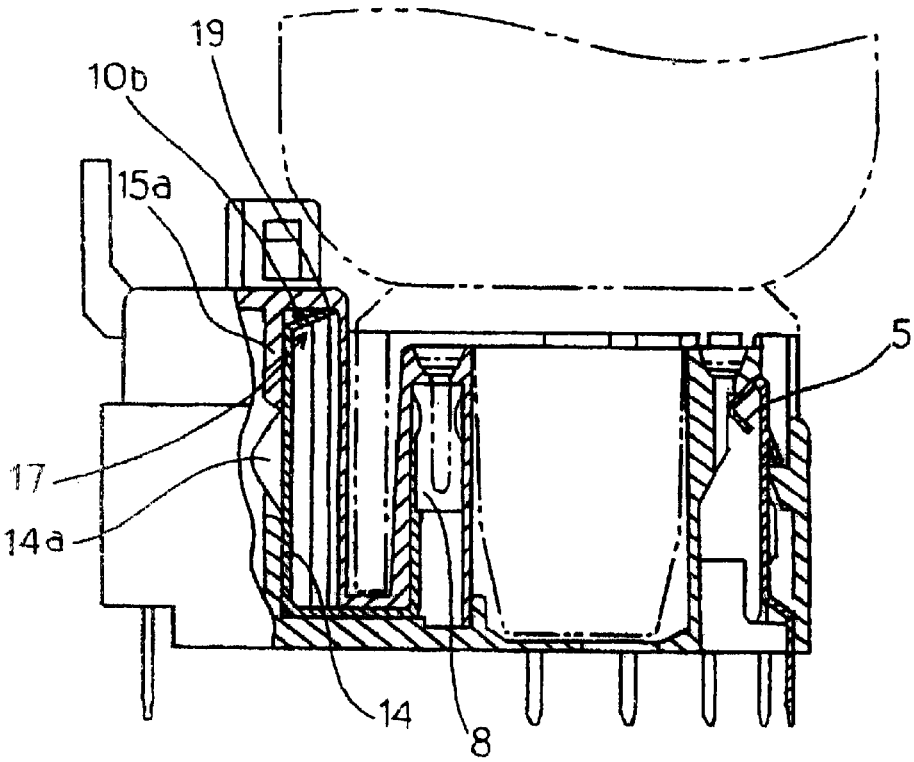
FIG. 2 is a side view of the CRT socket 2.

As shown in FIG. 1, a cylindrical rear side of the front portion is notched in a fan shape. When the box-shaped housing 4 is installed, a contact attaching portion 6 of the box-shaped housing 4, formed in a mutual compensating shape, is fitted to this notched portion.

Two contact storing concave portions 7 (FIGS. 3 and 7) insulated from each other are formed in this contact attaching portion 6. A focus contact 8 is inserted into each of the contact storing concave portions 7.

As shown in FIG. 1, two focus contacts 8 are disposed into the box-shaped housing 4 in the CRT socket in this embodiment. Pairs of resistance elements 10, 10, terminals 11, 11, focus side discharge electrode plates 14, 14, ground side discharge electrode plates 12, 12, etc. are attached in left-hand and right-hand symmetric positions in FIG. 1 in accordance with these two focus contacts 8. Accordingly, for convenience, one resistance element connecting structure (the right-hand side in FIG. 1) will be explained and the other explanation is omitted here.

A contact storing concave portion 7 for storing the focus contact 8 rises and positions the focus contact 8 in parallel with the other contacts 5 attached to the base housing 3. A peripheral portion of the contact storing concave portion 7 is sleeve shaped surrounded by a partition wall 7*a*. A bottom face (which is an upper side in FIG. 1 and is hereinafter called an open face) of the contact storing concave portion 7 is opened to attach the focus contact 8 from the open face side. The other extends through a plane side through a pin insertion hole 7*b*. This pin insertion hole 7*b* is located on the same circular circumference as a circular circumference on which the other contacts 5 are arranged. Thus, an unillustrated focus pin of the cathode ray tube connected to the CRT socket 2 is guided into the contact storing concave portion 7.

Figure 8:
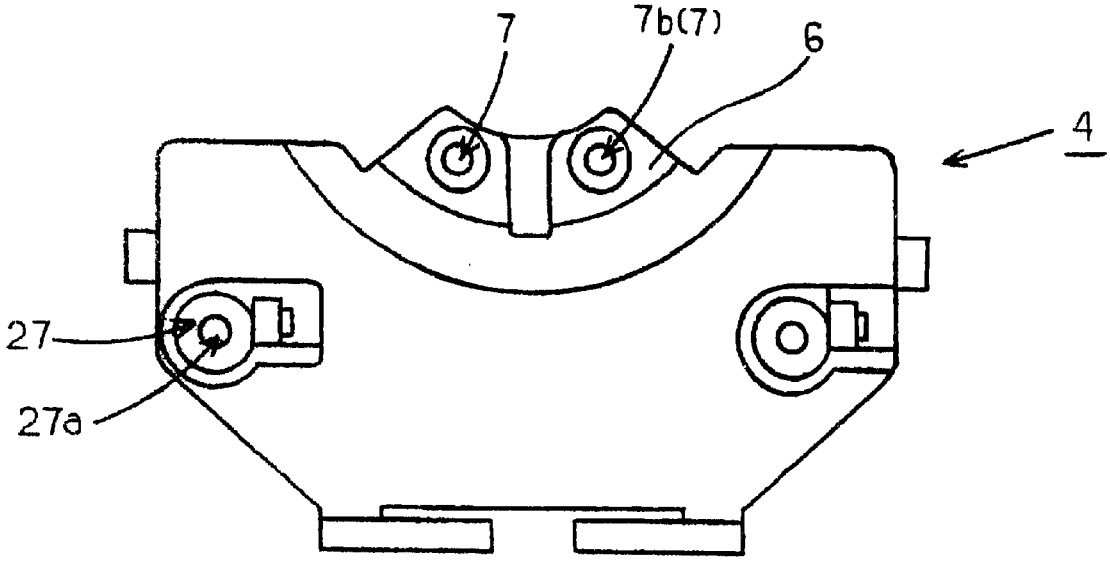
FIGS. 8(*a*) and 8(*b*) are respectively plan and bottom views of the boxshaped housing 4.
Figure 8:
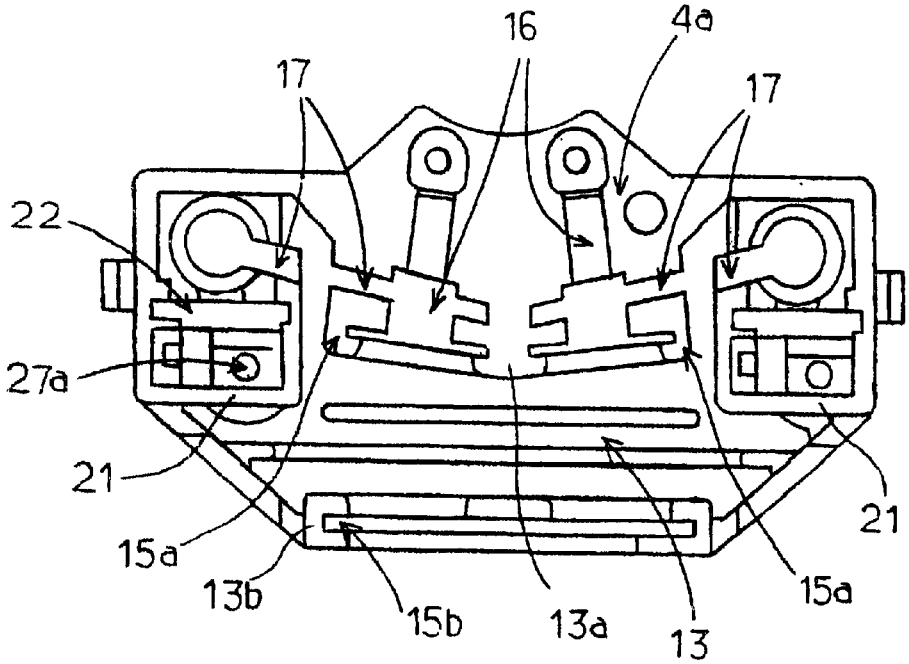

As shown in FIG. 8(*b*), a discharge air gap chamber 13 for discharging spark energy of the focus contact 8 is formed behind the box-shaped housing 4. Attaching frame portions 15*a*, 15*b* for positioning and storing a focus side discharge electrode plate 14 and a ground side discharge electrode plate 12 are respectively formed in a front side wall 13*a* and a rear side wall 13*b* of the discharge air gap chamber 13. A face of each of the attaching frame portions 15*a*, 15*b* on a side of the discharge air gap chamber 13 is notched in a U-shape from a side of the open face 4*a*.

The attaching frame portion 15*a* attaching the focus side discharge electrode plate 14 thereto is formed behind the contact storing concave portion 7. A portion between the attaching frame portion 15*a* and the contact storing concave portion 7 communicates with a storing groove 16 for positioning and storing a connecting plate 18 described later. Further, a lead positioning groove 17 for positioning and storing an inside lead portion 10*b* of a resistance element 10 is concavely formed along a front side (an outer side of the discharge air gap chamber 13) of the front side wall 13*a*. This lead positioning groove 17 is concavely formed such that the lead positioning groove 17 crosses the storing groove 16 from a terminal storing concave portion 22 described later. The inside lead portion 10*b* crosses on a front side (the outer side of the discharge air gap chamber 13) of the attaching frame portion 15*a* and is positioned by the lead positioning groove 17.

Figure 10:
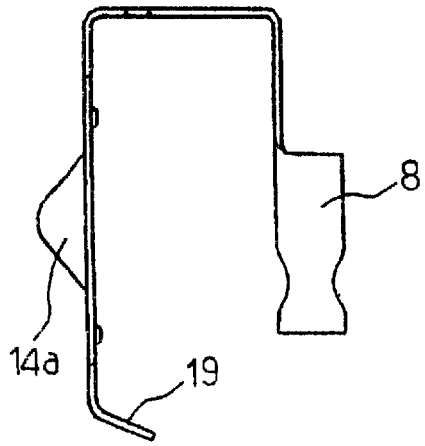
FIGS. 10(*a*), 10(*b*) and 10(*c*) are respectively side, plan and front views of a connecting plate 18 for integrally connecting a focus contact 8 and a focus side discharge electrode plate.
Figure 10:
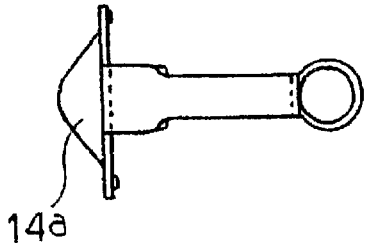
Figure 10:
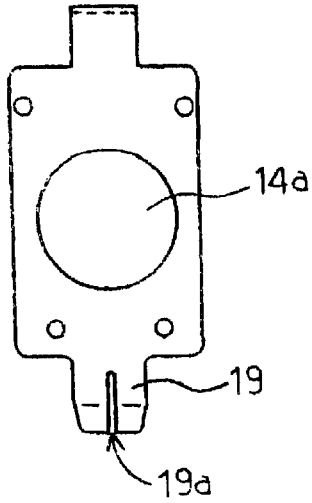
Figure 11:
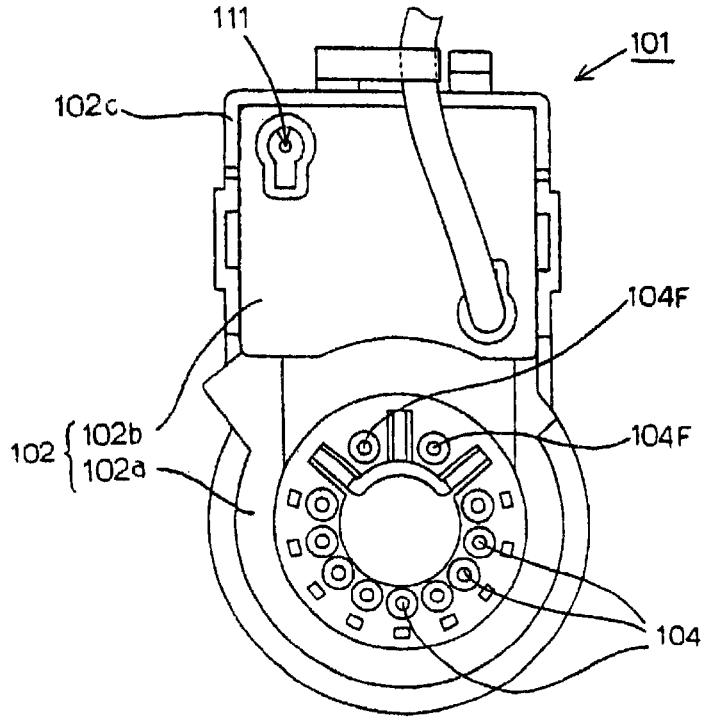
FIG. 11 is a plan view of a conventional CRT socket 101.
Figure 12:
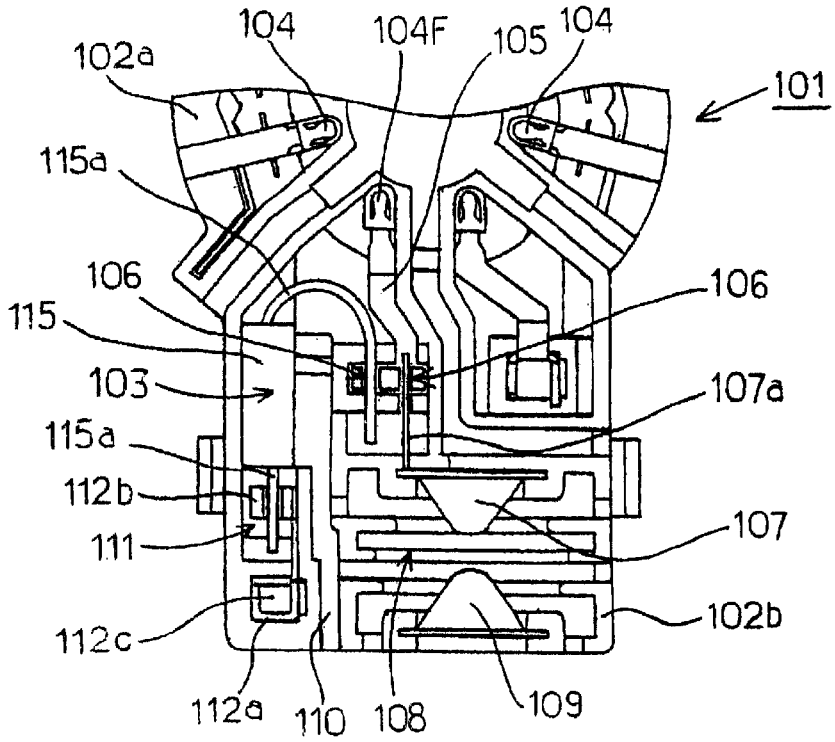
PRIOR ART Fig.12
FIG. 12 is a rear view of a main portion ofthe socket of FIG. 11 from which a bottom cover 102*c* of the CRT socket 101 is removed.
Figure 13:
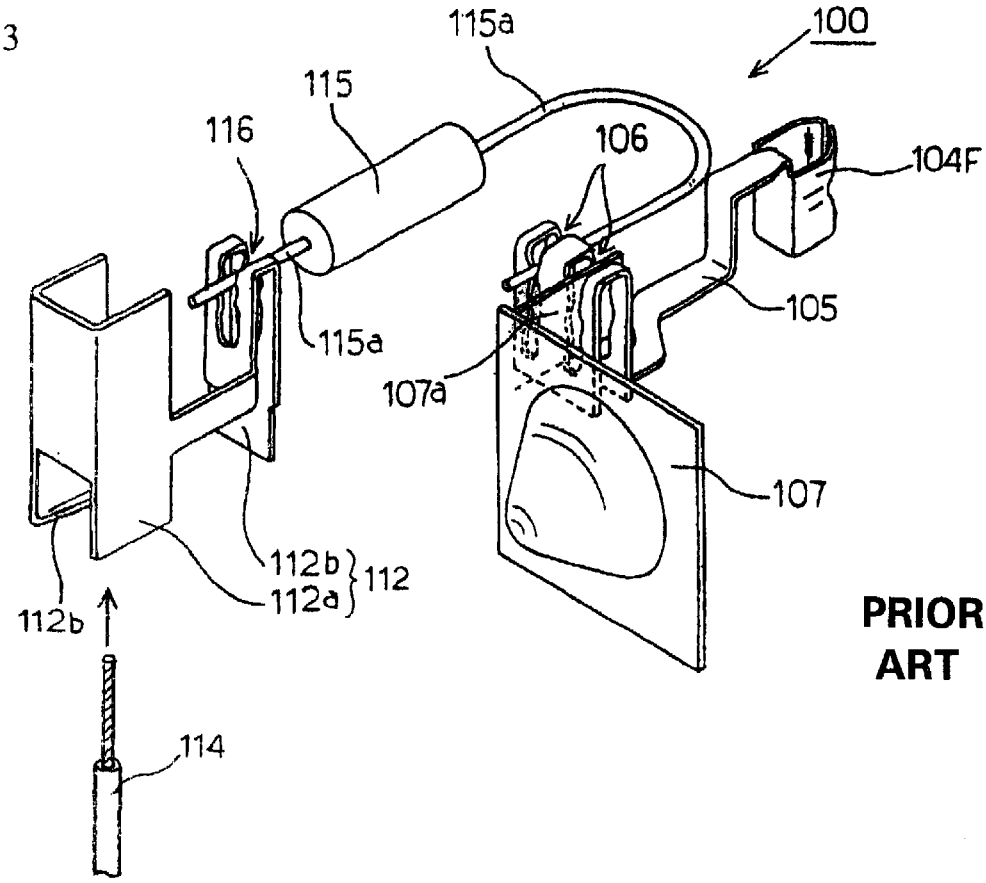
FIG. 13 is a perspective view of a main portion of the socket of FIG. 11 showing a resistance element connecting structure 100 of the conventional CRT socket.
Figure 14:
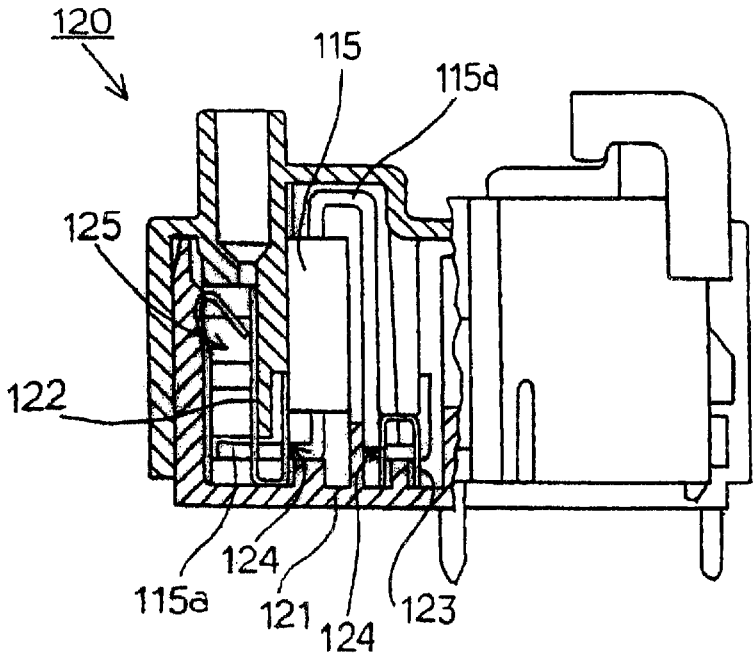
Fig.14 PRIOR ART
FIG. 14 is a longitudinal sectional view of a CRT socket showing another resistance element connecting structure 120 of the conventional CRT socket.

As shown in FIGS. 10(*a*)–10(*b*), the focus contact 8 in the contact storing concave portion 7 and the focus side discharge electrode plate 14 are integrally connected to each other by a connecting plate 18. These elements are press-molded from the same metallic plate. The connecting plate 18, and the connected elements begins as an elongated band shape in its longitudinal direction. The ends are bent in a downward direction perpendicular to the connecting plate 18. The focus contact 8 and the focus side discharge electrode plate 14 are integrally formed with the connecting plate.

One portion of the focus contact 8 is a partially drawn cylindrical shape to permit it to come into elastic contact with the focus pin. Focus contact 8 is attached to the pin insertion hole 7*b* and the sleeve-shaped contact storing concave portion 7 from a side of the open face 4*b*. The focus contact 8 is located on the same axial line as the pin insertion hole 4*b*.

The focus side discharge electrode plate 14 is a rectangular plate shape. An electrode portion 14*a* is struck out in a spherical shape at the center of the focus side discharge electrode plate 14. An elastic contact piece 19, projects slantingly downward from the bottom edge 14(*b*) of the rectangular plate in a direction opposite to a striking-out direction of the electrode portion 14*a*. The elastic contact piece 19 is forked into two branches from the bottom edge 14*b* by a slit 19*a* cut from the center of a free end of the elastic contact piece 19. The two branches are cantilevered. Each of the two branches of the elastic contact piece 19 comes into independent elastic contact with the inside lead portion 10*b* of the resistance element 10. The independent contact improves contact reliability.

The focus side discharge electrode plate 14 is attached to the attaching frame portion 15*a* along the front side wall 13*a* from the open face side. While both sides of the rectangular plate are engaged with the attaching frame portion 15*a*, the focus side discharge electrode plate 14 is press-fitted and attached to the attaching frame portion 15*a* on a lower side (a front face side). When the focus side discharge electrode plate 14 is perfectly attached to the attaching frame portion 15*a*, the electrode portion 14*a* of the focus side discharge electrode plate 14 is exposed through a U-shaped notch into the discharge air gap chamber 13. A free end of the elastic contact piece 19 reaches an inner bottom face of the lead positioning groove 17, where it comes into elastic contact with the inside lead portion 10*b* of the resistance element 10 positioned in the lead positioning groove 17.

In contrast to this, similar to the focus side discharge electrode plate 14, the ground side discharge electrode plate 12 is also formed with a spherical electrode portion 12*a* projecting from the center of a rectangular plate on its side. Both sides of the rectangular plate are engaged, positioned and fixed to a rear attaching frame portion 15*b* of the discharge air gap chamber 13. In this embodiment, a pair of other focus side discharge electrode plate 14 and other ground side discharge electrode plate 12 oppositely spaced by a discharge gap is integrally molded and attached along the rear side wall 13*b* of the discharge air gap chamber 13.

When the focus side discharge electrode plate 14 and the ground side discharge electrode plate 12 are positioned and fixed to the attaching frame portions 15*a*, 15*b*, the electrode portions 12*a*, 14*a* formed in a mutual spherical shape face each other in the discharge air gap chamber 13, and a discharge gap is formed between the electrode portions 12*a* and 14*a*.

Figure 4:
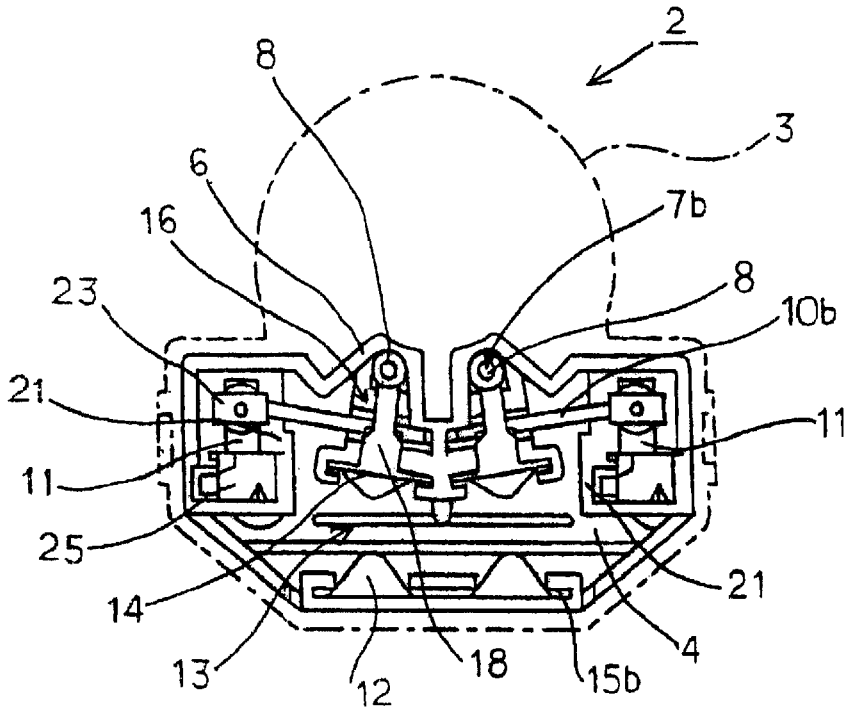
FIG. 4 is a bottom view of the CRT socket 2 in which a base housing 3 is omitted.

In this embodiment, as shown in FIG. 4, the discharge gap formed with respect to each of the two focus contacts 8 is formed in a radial shape from a central direction of the base housing 3. Thus, an insulating distance between the pair of focus discharge electrode plates 14 is sufficiently secured even when the connecting plate 18 is connected to a center of the focus discharge electrode plate 14. Accordingly, the focus contact 8, the connecting plate 18 and the focus side discharge electrode plate 14 can be integrally molded in a left-hand and right-hand symmetric shape as in this embodiment. Thus, the same part is usable in both locations without considering left-hand and right-hand attaching positions.

As shown in FIG. 8(*b*), a terminal storing concave portion 22 for storing the terminal 11 is concavely arranged from the open face side on a side partitioned by a circumferential wall 21 from the discharge air gap chamber 13 within the box-shaped housing 4.

Figure 9:
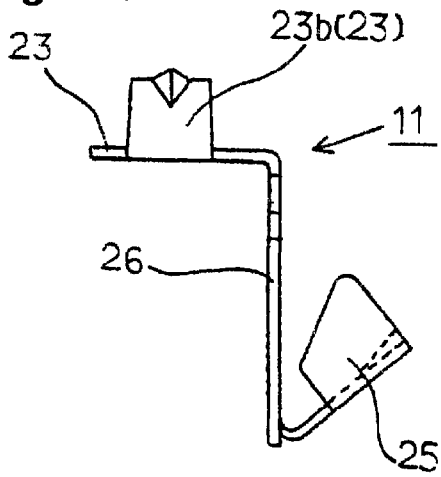
FIGS. 9(*a*), 9(*b*) and 9(*c*) are respectively side, front and plan views of the terminal 11.
Figure 9:
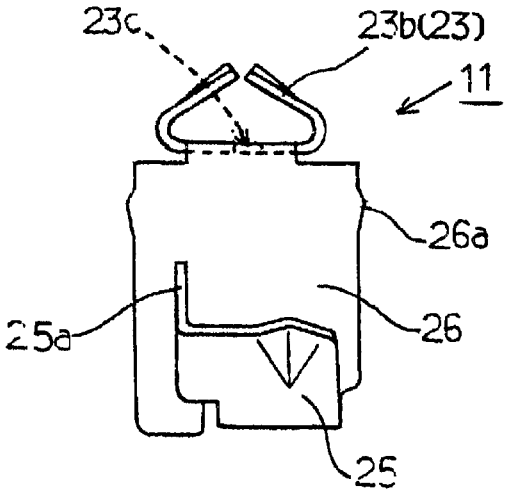
Figure 9:
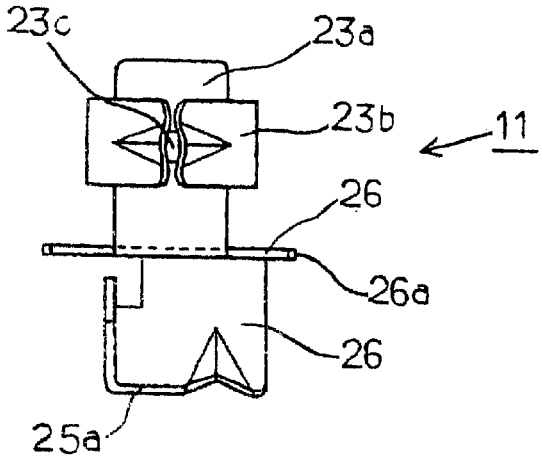

As shown in FIGS. 9(*a*)–(9*c*), the terminal 11 is constructed by a resistance connecting portion 23, an external connecting portion 25 and an attaching portion 26. The resistance connecting portion 23 is electrically connected to an outside lead portion 10*a* of the resistance element 10 arranged within the CRT socket 2. The external connecting portion 25 is electrically connected to an external lead wire 24 (FIG. 6) inserted from the exterior of the CRT socket 2. The attaching portion 26 integrally connects the resistance connecting portion 23 and the external connecting portion 25.

The resistance connecting portion 23 is made up of a horizontal base plate 23*a* and a pair of press contact pieces 23*b* curving inward from both sides of the horizontal base plate 23*a*. Free end portions of the pair of press contact pieces 23*b* abut each other by their own elasticities in an upper portion of the horizontal base plate 23*a* in FIG. 9. An insertion hole 23*c* for inserting the outside lead portion 10*a* of the resistance element 10 pierces the center of the horizontal base plate 23*a*. The insertion hole 23*c* guides a tip of the outside lead portion 10*a* to an abutting position between the press contact pieces 23*b*.

The attaching portion 26 is constructed from a plate-shaped piece for connecting the resistance connecting portion 23 and the external connecting portion 25 in a vertical direction. Engaging claws 26*a* are formed on both sides of the attaching portion 26, to fixedly position the terminal 11 within the terminal storing concave portion 22.

The external connecting portion 25 is bent slantingly upward from a lower end of the attaching portion 26, and an L-shaped flange piece 25*a* rises along a side and a tip of the external connecting portion 25. The flange piece 25*a* reinforces the external connecting portion 25 to reinforce the external connecting portion 25 against bending that no intermediate portion ofthe external connecting portion 25 is curved. Thus, a tip of the external connecting portion 25 is vertically flexed with a lower end of the attaching portion 26 as a basic end.

Figure 5:
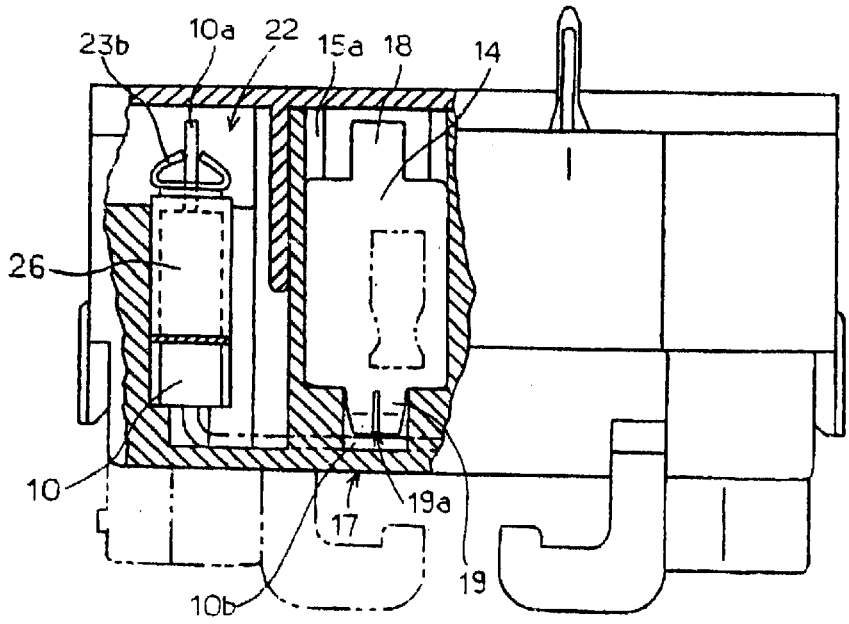
FIG. 5 is a longitudinal sectional view cut in an attaching portion 26 of a terminal 11.
Figure 6:
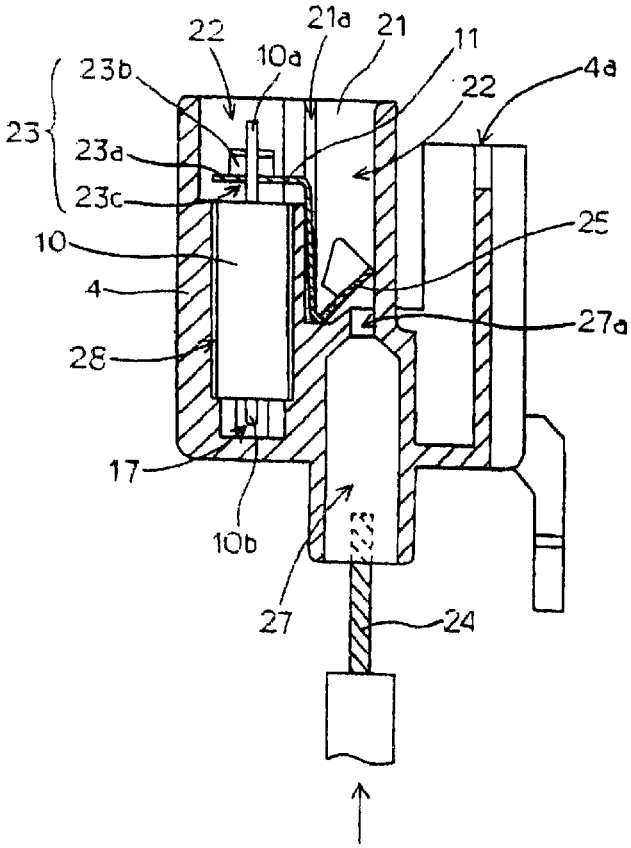
FIG. 6 is a longitudinal sectional view of a terminal storing concave portion 22 cut in a direction perpendicular to that in FIG. 5.
Figure 7:
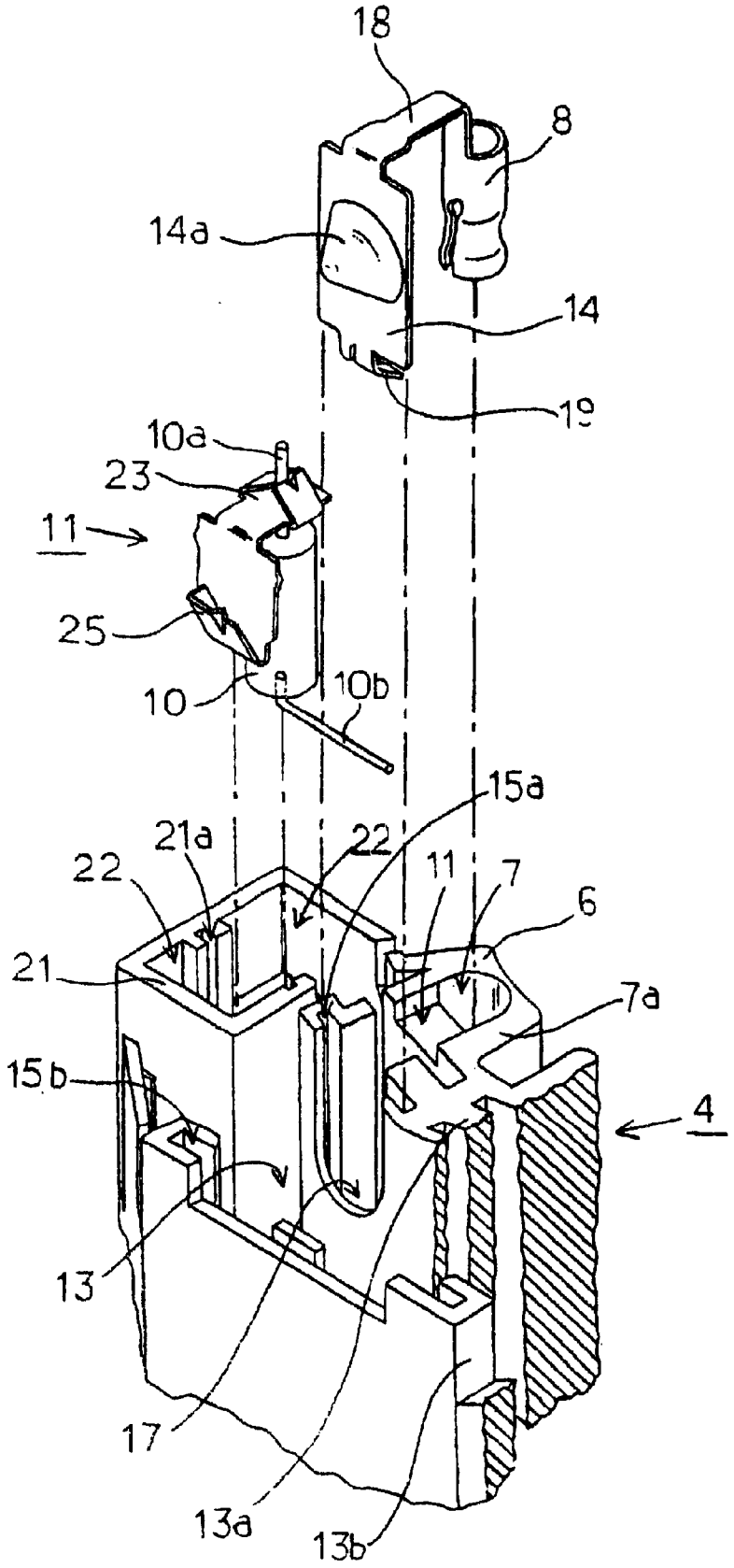
FIG. 7 is an exploded perspective view of a main portion of a box-shaped housing 4.

Each of FIGS. 5 and 6 shows a state in which the terminal 11 constructed in this way is stored to the terminal storing concave portion 22. FIG. 5 is a longitudinal sectional view cut in the attaching portion 26 of the terminal 11. FIG. 6 is a longitudinal sectional view of the terminal storing concave portion 22 cut in a direction perpendicular to that in FIG. 5.

The terminal storing concave portion 22 is formed in a square sleeve shape by the circumferential wall 21 rising on the open face side from an inner bottom face side (a lower side in FIG. 6) of the box-shaped housing 4. A pair of attaching grooves 21*a* is concavely formed in a vertical direction on an inner wall face of the circumferential wall 21. The resistance connecting portion 23 of the terminal 11 is stored to the terminal storing concave portion 22 on a left-hand side in FIG. 6 with respect to the attaching grooves 21*a*, and the external connecting portion 25 is stored to the terminal storing concave portion 22 on a right-hand side in FIG. 6 with respect to the attaching grooves 21*a*.

A lead insertion hole 27 communicates with an inner portion (a lower portion) of the terminal storing concave portion 22 for storing the external connecting portion 25. The lead insertion hole 27 is opened to a plane side of the box-shaped housing 4 through a guide hole 27*a*. The external lead wire 24 inserted from the plane side of the CRT socket can be inserted into the terminal storing concave portion 22 through the lead insertion hole 27.

A cylindrical resistance storing portion 28 for storing and positioning the resistance element 10 is continuously formed in the terminal storing concave portion 22 in an inner portion (a lower portion) of the terminal storing concave portion 22 for storing the resistance connecting portion 23. The above lead positioning groove 17 communicates with an inner bottom face of the resistance storing portion 28. The inside lead portion 10*b* of the resistance element 10 is guided to the lead positioning groove 17.

Thus, the resistance storing portion 28 is formed in the inner portion of the terminal storing concave portion 22, i.e., within a projecting shape of the terminal storing concave portion 22 to a plane of the box-shaped housing 4. Accordingly, no large box-shaped housing 4 is required to form the resistance storing portion 28. Further, since the resistance element 10 is insulated from other parts such as the contact 5, the ground side discharge electrode plate 12, etc. by the circumferential wall 21 for forming the terminal storing concave portion 22, it is a separate partition wall to insulate the resistance element 10 is not needed.

As shown in FIG. 5, the circumferential wall 21 is notched in the lead positioning groove 17 formed in this resistance storing portion 28. The lead positioning groove 17 extends along a front portion of the front side wall 13*a* until a portion crossing the storing groove 16.

A method for connecting and assembling the resistance element 10 into the CRT socket having such a construction will next be explained.

The respective parts such as the resistance element 10, the terminal 11, etc. are attached to the box-shaped housing 4 while a side of the open face 4*a* of the box-shaped housing 4 is directed upward. Accordingly, in the explanation of an attaching process of these parts, the open face side is set to an upper side and a plane side is set to a lower side.

First, the resistance element 10 rises such that the outside lead portion 10*a* is directed upward and the inside lead portion 10*b* is directed downward. The resistance element 10 is then stored into the resistance storing portion 28. When the resistance element 10 is stored in the resistance storing portion 28, the outside lead portion 10*a* projects into the terminal storing concave portion 22 above the resistance storing portion 28. The inside lead portion 10*b* is guided from a lower portion of the resistance storing portion 28 to the lead positioning groove 17. A tip of the inside lead portion 10*b* is temporarily held in a state in which this tip crosses the storing groove 16.

Subsequently, the terminal 11 is horizontally supported with the resistance connecting portion 23 located on an upper side of the resistance element 10 and the external connecting portion 25 located on an upper side ofthe guide hole 27*a*. While the engaging groove 26*a* of the attaching portion 26 is slid to the attaching groove 21*a* of the terminal storing concave portion 22, the terminal 11 is press-fitted from above into the terminal storing concave portion 22. At this time, the outside lead portion 10*a* of the resistance element 10 is inserted into the insertion hole 23*c* of the resistance connecting portion 23 and is nipped between the press contact pieces 23*b*.

Accordingly, when the terminal 11 is fully inserted into the terminal storing concave portion 22, the engaging claw 26*a* is engaged with the attaching groove 21*a* and is fixed into the terminal storing concave portion 22. Further, the terminal 11 and the outside lead portion 10*a* of the resistance element 10 are electrically connected to each other. As shown in FIG. 6, a tip of the external connecting portion 25 makes elastic contact with an inner wall face of the terminal storing concave portion 22 above the guide hole 27*a* by elasticity of this tip.

After the terminal 11 is attached, the connecting plate 18 integrating the focus contact 8 and the focus side discharge electrode plate 14 with each other is attached to the box-shaped housing 4.

In this attachment, while the focus contact 8 is aligned within the contact storing concave portion 7, the focus side discharge electrode plate 14 is press-fitted downward along the front side wall 13*a* until both sides of the rectangular plate of the focus side discharge electrode plate 14 are engaged with the attaching frame portion 15*a* and are thereby fixedly positioned.

When the connecting plate 18 is perfectly attached to the attaching frame portion 15*a*, the connecting plate 18 is positioned and stored to the storing groove 16. The focus contact 8 lies above the pin insertion hole 7*b*. Further, the electrode portion 14*a* of the focus side discharge electrode plate 14 is exposed from the U-shaped notch into the discharge air gap chamber 13. A free end of the elastic contact piece 19 comes into elastic contact with the inside lead portion 10*b* of the resistance element 10 positioned in the lead positioning groove 17. Thus, the inside lead portion 10*b* of the resistance element 10 is connected to the focus contact 8 through the focus side discharge electrode plate 14, and the resistance element 10 is connected in series between the focus contact 8 and the terminal 11.

Thereafter, a peripheral portion of the rectangular plate of the ground side discharge electrode plate 12 is fitted to the attaching frame portion 15*b* on a rear face of the discharge air gap chamber 13 so that the ground side discharge electrode plate 12 is attached. Further, a discharge gap is formed within the discharge air gap chamber 13 such that the focus side discharge electrode plate 14 and the ground side discharge electrode plate 12 are opposed to each other in the discharge gap.

After the respective parts are attached to the box-shaped housing 4, plural contacts 5 are attached to the base housing 3. As shown in FIG. 3, the box-shaped housing 4 is stored to a rear portion of the base housing 3, and engaging portions of the base housing 3 and the box-shaped housing 4 are engaged and integrated with each other.

The CRT socket having the respective parts assembled in this way is mounted onto a printed wiring board within a television receiver. Thereafter, one end of the external lead wire 24 connected to a flyback transformer is inserted from the lead insertion hole 27 opened to the plane side of the box-shaped housing 4. A tip of the external lead wire 24 inserted from the lead insertion hole 27 is inserted into the terminal storing concave portion 22 through the guide hole 27*a*, and is nipped between an inner wall face of the terminal storing concave portion 22 and the external connecting portion 25.

Accordingly, the resistance element 10 is connected in series between the focus contact 8 and the external lead wire 24 having one end connected to the flyback transformer.

The present invention is not limited to the above embodiment, but can be variously modified. For example, the box-shaped housing 4 may be also integrated with the base housing 3 by separately preparing a cover body for covering an open face. Further, the open face side of the box-shaped housing 4 may be also set to a connecting face side with the CRT by setting a shape of the focus contact 8 to a reverse shape on upper and lower sides.

The focus contact 8 and the discharge electrode plate 14 are integrally molded. However, it is not always necessary to integrally mold these parts if these parts are attached to the box-shaped housing 4 and are then electrically connected to each other.

Further, in the above embodiment, the resistance element 10 is inserted into the resistance storing portion 28 before the attachment of the terminal 11. However, the outside lead portion 10*a* may be also connected to the resistance connecting portion 23 of the terminal 11 in advance, and the resistance element 10 may be also attached into the box-shaped housing 4 together with the attachment of the terminal 11.

The present invention can be also applied to a case in which the resistance element is connected to a CRT socket having only one focus contact instead of the CRT socket of a double focus type as in this embodiment.

In accordance with the invention, the inside lead portion 10*b* of the resistance element 10 can be electrically connected only by attaching the focus side discharge electrode plate so that electric connection to the focus contact 8 is very facilitated.

Further, there are no works in which a lead portion bent within a narrow space of the CRT socket is press-fitted and soldered. Accordingly, the resistance element 10 can be simply connected.

In accordance with the invention, in addition to the embodiment in the preceding paragraphs, the resistance storing portion 28 is continuously arranged in an inner portion of the terminal storing concave portion along an attaching direction of the terminal 11. Accordingly, the resistance storing portion 28 for storing the resistance element 10 can be formed by utilizing a vacant space within the CRT socket.

In accordance with the invention, in addition to the invention of the foregoing paragraphs, the focus contact 8 and the focus side discharge electrode plate 14 are integrally molded. Accordingly, no electric connecting process is required between the focus contact 8 and the focus side discharge electrode plate 14. Further, the number of parts is not increased, and an attaching work of the focus contact 8 and the focus side discharge electrode plate 14 to the box-shaped housing 4 can be simplified.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A resistance element connecting structure of a CRT socket comprising:

a focus contact connectable to a focus pin of a cathode ray tube;

a terminal connectable to an external lead wire;

a focus side discharge electrode plate connected to said focus contact (8);

a ground side discharge electrode plate;

a housing;

said housing including a contact storing concave portion for storing said focus contact;

a terminal storing concave portion for storing said terminal;

a discharge air gap chamber across which said focus side discharge electrode plate and said ground side discharge electrode plate are spaced from each other by a discharge gap;

said discharge air gap chamber being concavely arranged from an open face on one side of said housing;

a resistance element connected in series between said focus contact attached from said open face to said contact storing concave portion and said terminal attached from said open face to said terminal storing concave portion;

said focus side discharge electrode plate being a metallic plate having an electrode portion projecting therefrom;

an elastic contact piece projecting from a bottom edge of said metallic plate in a direction reverse to a projecting direction of said electrode portion;

an attaching frame portion for nipping and fixing both sides of said focus side discharge electrode plate;

said attaching frame portion being formed in a side wall surrounding said discharge air gap chamber of said housing;

an inside lead portion of said resistance element having an outside lead portion connected to said terminal;

said inside lead portion being disposed outside said side wall;

said bottom edge of said metallic plate is directed toward an interior of said housing;

said focus side discharge electrode plate is attached to said attaching frame portion from said open face along said side wall;

said electrode portion of said focus side discharge electrode plate faces said discharge air gap chamber;

said elastic contact piece projected to an outer side from said side wall of said discharge air gap chamber elastically contacts said inside lead portion of said resistance element; and said focus side discharge electrode plate, connected to said focus contact, is connected to said inside lead portion of said resistance element.

2. The resistance element connecting structure of said CRT socket as defined in claim 1, wherein said terminal has an external connecting portion connected to said external lead wire, and a resistance connecting portion integrally and continuously arranged on a side of said external connecting portion;

a resistance storing portion is continuously arranged inward along an attaching direction of said terminal from a portion of said terminal storing concave portion storing said resistance connecting portion therein; and said resistance element having said outside lead portion connected to said terminal is stored to said resistance storing portion.

3. The resistance element connecting structure of said CRT socket as defined in claim 1, wherein said focus contact and said focus side discharge electrode plate are integrally molded by punching said metallic plate.

4. The resistance element connecting structure of said CRT socket as defined in claim 2, wherein said focus contact and said focus side discharge electrode plate are integrally molded by punching said metallic plate.

5. A resistance element connecting structure of a CRT socket comprising:

a housing;

said housing having an open side;

a first concavity in said housing facing said open side for receiving a resistance element therein through said open side;

said resistance element having a lower lead and an upper lead;

a resilient contact contacting said lower lead;

said resilient contact being connected to a first discharge element;

said resilient contact also being connected to a terminal permitting connection to a CRT;

a second discharge element connected to a contact in said socket;

said contact being connectable to ground when said socket is installed:

said first and second discharge elements facing each other across a discharge gap;

said first and second discharge elements being insertable into said housing through said open side;

a terminal affixable in said socket through said open side;

a first pinch-type contact on said terminal fitting onto said upper lead to provide electrical connection between said upper lead and said first pinch-type contact;

a second pinch-type contact on said terminal;

means for permitting insertion of a lead to said second pinch-type contact for applying a voltage through said terminal and said resistance element to said CRT.

* * * * *